United States Patent [19]

Perkitny

[11] Patent Number: 4,824,413

[45] Date of Patent: Apr. 25, 1989

[54] TOY VEHICLE WITH ROTATABLE POWER PACK

[75] Inventor: Jerzy Perkitny, Bay Village, Ohio

[73] Assignee: Those Characters from Cleveland, Cleveland, Ohio

[21] Appl. No.: 191,710

[22] Filed: May 9, 1988

[51] Int. Cl.[4] ..... A63H 17/00; A63H 33/22; A63H 17/26

[52] U.S. Cl. ..... 446/94; 446/219; 446/466

[58] Field of Search ..... 446/90, 94, 95, 219, 446/460, 442, 443, 465, 466, 462, 468

[56] References Cited

U.S. PATENT DOCUMENTS

| | | | |
|---|---|---|---|
| 2,161,970 | 6/1939 | Muller | 252/33.3 |
| 2,161,971 | 6/1939 | Muller | 252/33.3 |
| 2,218,394 | 10/1940 | Elliott | 446/94 |
| 2,382,982 | 8/1945 | Elliott | 446/94 |
| 2,641,869 | 6/1953 | Raze | 446/460 |
| 2,708,811 | 5/1955 | Crowder | 446/442 |
| 2,932,917 | 4/1960 | Patane | 446/392 |
| 3,553,885 | 1/1971 | Tazaki | 446/279 |
| 3,871,129 | 3/1975 | Tong | 446/437 |
| 3,961,440 | 6/1976 | Saito | 446/464 |
| 4,057,929 | 11/1977 | Ogawa | 446/90 |
| 4,167,830 | 9/1979 | Ogawa | 446/90 |
| 4,214,402 | 7/1980 | Ogawa | 446/90 |
| 4,224,762 | 9/1980 | McCaslin | 446/456 |
| 4,248,006 | 2/1981 | Jones et al. | 446/89 |
| 4,463,518 | 8/1984 | Smathers et al. | 446/237 |
| 4,463,520 | 8/1984 | Crosman | 446/443 |
| 4,504,239 | 3/1985 | Kulesza et al. | 446/95 |
| 4,559,022 | 12/1985 | Herstein | 446/219 |

*Primary Examiner*—Robert A. Hafer
*Assistant Examiner*—Michael Brown
*Attorney, Agent, or Firm*—Calfee, Halter & Griswold

[57] ABSTRACT

The toy vehicle of the present invention includes a body having two idler wheels and a battery driven power pack rotatably mounted therein, the power pack having a driven wheel mounted thereon and rotating therewith. The rear driven wheel has 360° of movement relative to the body selectively to allow the body to be driven in any direction. The body has a battery powered flashlight assembly mounted therein and may be adapted to receive a plurality of snap-on pieces to change the appearance and apparent function of the toy vehicle.

9 Claims, 3 Drawing Sheets

TOY VEHICLE WITH ROTATABLE POWER PACK

FIELD OF THE INVENTION

The present inventions relates to a toy vehicle in general and to a toy vehicle having a driven wheel mounted on and rotatable with a battery driven power pack in particular.

BACKGROUND OF THE INVENTION

McCaslin U.S. Pat. No. 4,224,762 discloses a motor driven remote controlled toy vehicle. This toy vehicle has its rear wheels driven by a motor through a worm gear connection. In one embodiment, an idler steering wheel is mounted centrally of the vehicle toward its front end. This idler steering wheel can be moved through an effective arcuate angle relative to the toy vehicle of just less than 180° to allow the vehicle to be steered to the left, to the right or straight ahead.

Smith U.S. Pat. No. 1,912,541 discloses a toy vehicle having a battery operated light source and wheel motor within a module. Jones U.S. Pat. No. 4,248,006 discloses a toy having a power operated base module to which various components can be secured to provide a vehicle of desired appearance.

SUMMARY OF THE INVENTION

The principal object of the present invention is to provide a base module for a toy vehicle having a power pack rotatably mounted in the body to permit the wheel driven thereby to be rotated through 360° relative to the body. The rotatable mounting of the power pack in the vehicle body permits the drive wheel to drive the toy vehicle in any direction.

Another object of the present invention is to provide a toy vehicle capable of being driven by a rotatable power pack in any direction having a light assembly mounted therein. This light assembly allows the toy vehicle to be used in the dark and also provides a flashlight when needed.

It is still another object of the present invention to provide a toy vehicle capable of being driven by a rotatable power pack in any direction acting as a base module for snap-on elements or pieces. These pieces may take many different configurations and can be removably connected to the base module to form vehicles of many different appearances and apparent functions.

These and other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principle of the invention may be employed.

DETAILED DESCRIPTION OF THE PREFERRED EMBODIMENT

Figure 1:
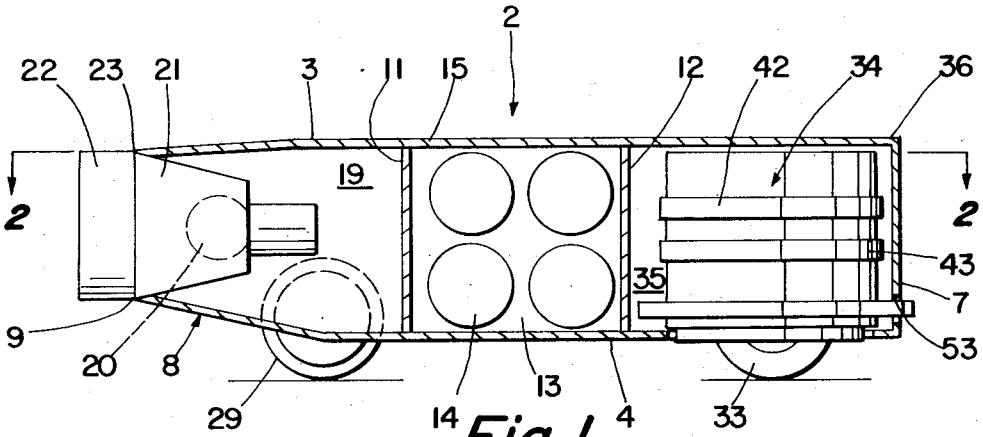
FIG. 1 is a longitudinal, vertical cross section of the toy vehicle body of the present invention illustrating the flashlight compartment, the battery compartment and the power pack compartment.
Figure 2:
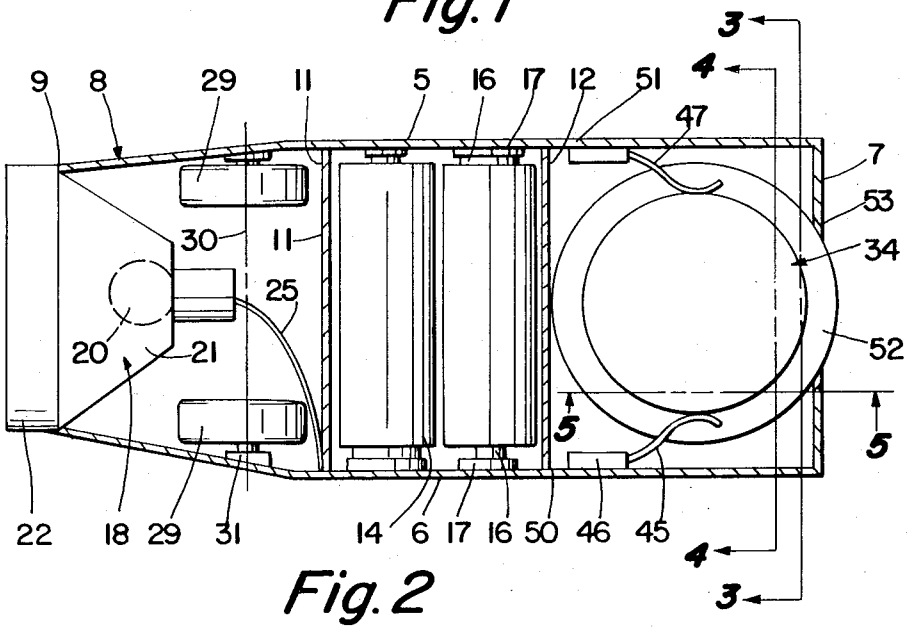
FIG. 2 is a horizontal section in plan taken generally along the plane 2—2 in FIG. 1 showing the details of the idler wheel assembly and the resilient contact brushes engaging contact strips on the power pack.
Figure 3:
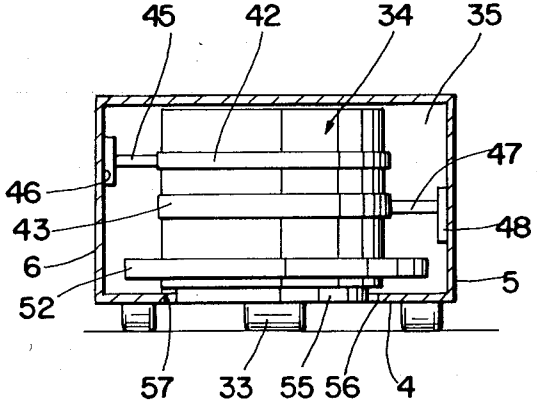
FIG. 3 is a rear transverse vertical section taken generally along the plane 3—3 in FIG. 2 showing the details for rotatably mounting the power pack in the toy vehicle body.

Referring now in more detail to the drawings and initially to FIGS. 1 through 3, the toy vehicle of the present invention includes a body, indicated generally at 2. The body, which is preferably molded plastic, includes a top wall 3, a bottom 4, widewalls 5 and 6 and back wall 7. Adjacent the front end of the body, the top, bottom and two side walls converge slightly inwardly relative to one another (as generally indicated at 8) cooperatively to define a front opening 9.

The body 2 has a first transverse partition 11 and a second transverse partition 12 to divide the inside of the body 2 into three compartments. The center compartment 13, positioned between partitions 11 and 12, is adapted to receive batteries 14. The top wall 3 of body 2 is provided with a door 15 providing access to the battery compartment 13 for installing and removing the batteries 14.

As shown, four AA batteries are received in a stacked pair orientation, with the side-by-side batteries being positioned in opposite directions with their respective battery terminals 1 in engagement with circuit contacts 17. The batteries 14 provide electrical power for the toy vehicle and may be individually or collectively replaced when their charge is depleted. The batteries 14 in the toy vehicle of the present invention are used for at least two electrical functions including energizing a flashlight assembly and a motor driven wheel.

In this regard, a flashlight assembly, indicated generally at 18, is positioned in front body compartment 19 and includes a lamp 20 received in the base of a reflector dish 21. This reflector dish 21 has a flange 22 mounted thereon to define a shoulder 23 engaging the front walls of the body around front opening 9. A transparent or translucent lens 24 (FIG. 7) is secured in and extends across the flange 22 to form the front wall of body 2. The lamp 20 is electrically connected to the electric circuit of the body as schematically illustrated by wires 25. A conventional on/off switch 27 (FIG. 6) is provided to turn the flashlight assembly 18 on and off. When illuminated, light passes from lamp 20 through the reflective pan and lens to provide an entirely illuminated front wall of the body to act as a flashlight or headlight.

Turning now to the second electrical function, the electric circuit powers a driven wheel cooperating with idler wheels to provide support and mobility for body 2. In this context, the front body compartment 19 has a pair of spaced idler wheels 29 mounted on transverse axle 30 rotatably mounted to the side walls 5 and 6 by bushings 31. Idler wheels 29 are preferably received within the confines of the body 2 as illustrated.

Body 2 is supported adjacent its rear end by driven wheel 33. The driven wheel 33 is mounted on and rotates about a vertical axis with the power pack 34 received in rear compartment 35 of body 2. Although one driven wheel is illustrated, it will be understood that power pack 34 could drive more than one rear wheel, if desired. The top wall 3 of body 2 may be provided with a second door 36 to provide access to the rear compartment 35 for installing or removing the power pack 34.

Figure 4:
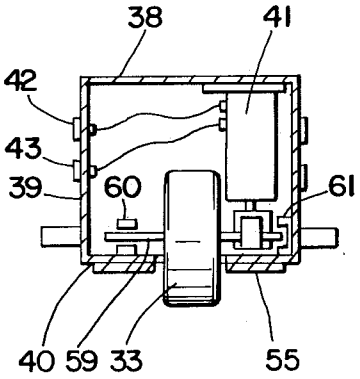
FIG. 4 is a vertical transverse section through the power pack taken generally along the plane 4—4 in FIG. 2 showing the details for mounting the driven wheel on the power pack.
Figure 5:
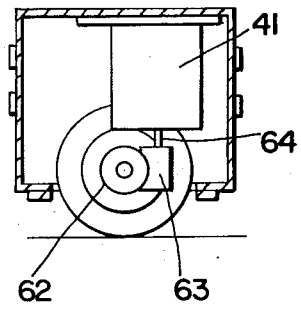
FIG. 5 is a vertical longitudinal section taken generally along the plane 5—5 in FIG. 2 showing the details of the drive connection between the electric motor and the driven wheel of the power pack.

As best shown in FIGS. 4 and 5, the power pack 34 includes a closed end, cylindrical body having top wall 38, annular side wall 39 and bottom wall 40. An electric motor 41 of from three to six volts is mounted to top wall 38 of the power pack body. This motor 41 is powered by the electrical circuit of body 2.

To this end, annular wall 39 of power pack 34 is provided with two annularly continuous and vertically spaced contact strips 42 and 43. Contact strip 42 is resiliently engaged by contact brush 45 on contact assembly 46 mounted to side wall 6. Similarly, contact strip 43 is engaged by resilient contact brush 47 on contact assembly 48 mounted to side wall 5. Resilient contact brushes 45 and 47 are biased radially inwardly and are preferably diametrically opposed (as shown in FIG. 2) but vertically staggered. The brush 45 and 47 are normally spaced apart by a diametrical distance less than the diameter of the contact strips 42 and 43 thereby requiring the brushes resiliently to expand radially outwardly to engage the strips. The brushes thus exert a positive bias on the contact strips to maintain good electrical contact therebetween.

Contact assemblies 46 and 48 are connected in the electrical circuit of the body 2 as respectively schematically illustrated in FIG. 2 by wires 50 and 51 extending between the battery contacts and the contact assemblies. The brush contacts 45 and 47 provide continuous electrical contact with the power pack 34 either when the motor pack is stationary or is being rotated.

For selective rotation, the annular side wall 39 of power pack 34 has a thumb wheel flange 52 mounted or formed thereon and extending radially outwardly therefrom. Part of the annularly continuous thumb wheel flange 52 extends through a horizontal opening 53 in the rear wall 7 of body 2. The exposed portion allows a person to turn the thumb wheel flange to rotate the power pack and drive wheel mounted thereon relative to the body 2.

This rotation is, in part guided and accommodated by a circular bearing plate 55 mounted on bottom wall 40. The bearing plate 55 is slightly smaller in diameter than bottom wall 40 of power pack 34 to form a horizontal annular shoulder 56. As best shown in FIG. 3, the bearing plate 55 is closely received in a hole 57 in the bottom wall 4 of body 2, with the horizontal annular shoulder 56 being above the bottom wall 4 in closely spaced relationship therewith to allow the power pack to rotate relative to the body 2. This rotation is thus accommodated and the power pack positioned in rear compartment 35 by the cooperative interrelationship of the contact brushes 45 and 47, the thumb wheel flange 52 and the bearing plate 55.

As the power pack is rotated, the driven wheel 33 rotates about a vertical axis relative to body 2 to allow the body to be driven in any selected direction. The driven wheel 33 is secured on axle 59 rotatably mounted in body 2 by spaced bearing blocks 60 and 61. A worm gear 62 is mounted on axle 59 and cooperates with and is driven by worm 63 mounted on the rotatable drive shaft 64 of motor 41. The motor 41 is controlled by a conventional on/off switch.

When the switch is on, motor 41 will be actuated rotatably to drive shaft 64, worm 63, cooperating worm gear 62 and axle 59 to provide power in one direction to wheel 33. Motor 41 thus rotates driven wheel 33 about its horizontal axis turned by axle 59.

This driven wheel 33 can be selectively rotated through 360° relative to the body 2 by rotating the power pack 34. Thus, for example, by rotating the wheel 33 through 180°, the body 2 can be driven in a reverse direction by wheel 33. Similarly, any other selected angular orientation of wheel 33 relative to body 2 will result in turning movement of the body in the direction that wheel 33 is pointed.

Figure 6:
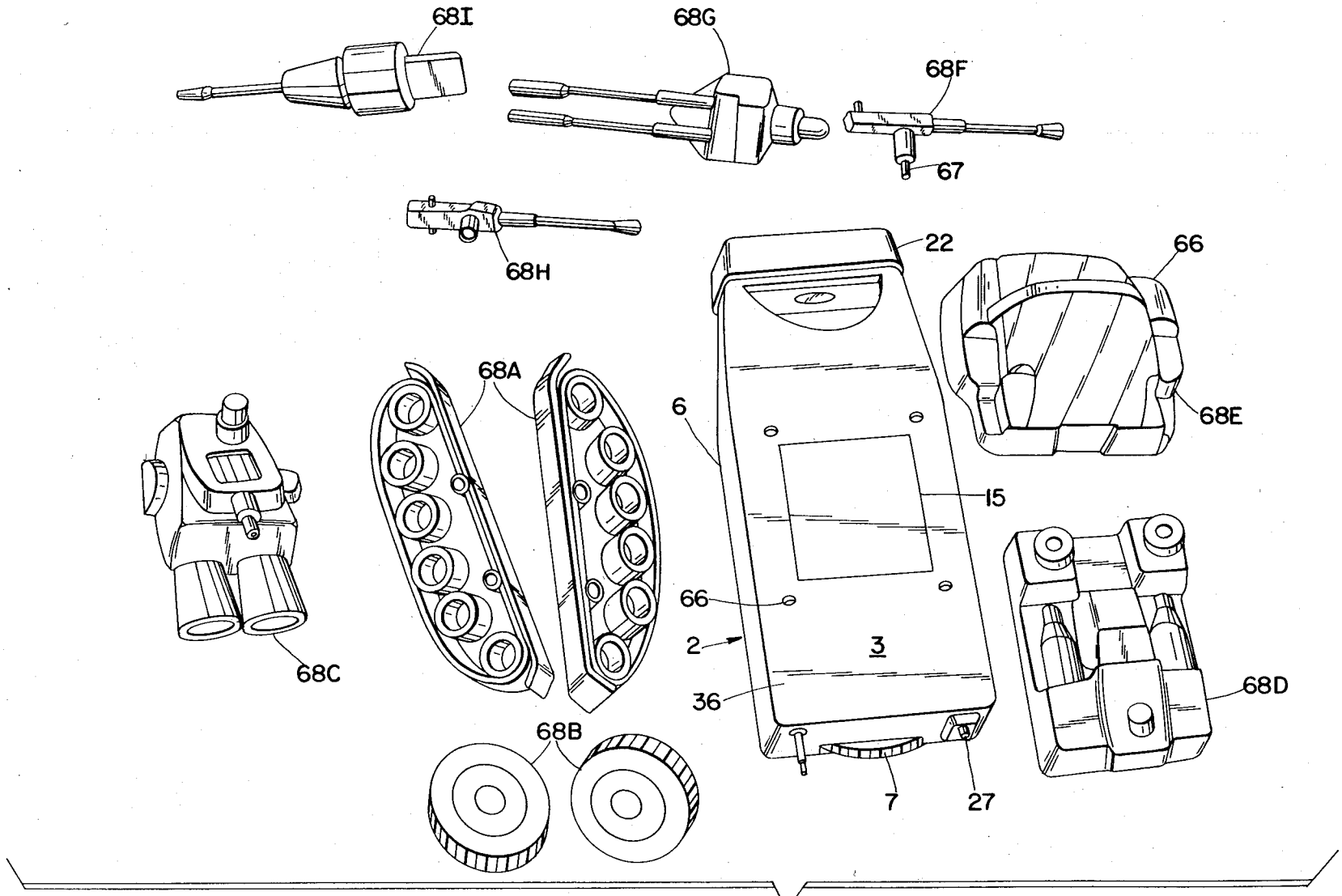
FIG. 6 is a perspective of the toy vehicle body and unassembled snap-on parts adapted to be connected to the body or to one another.
Figure 7:
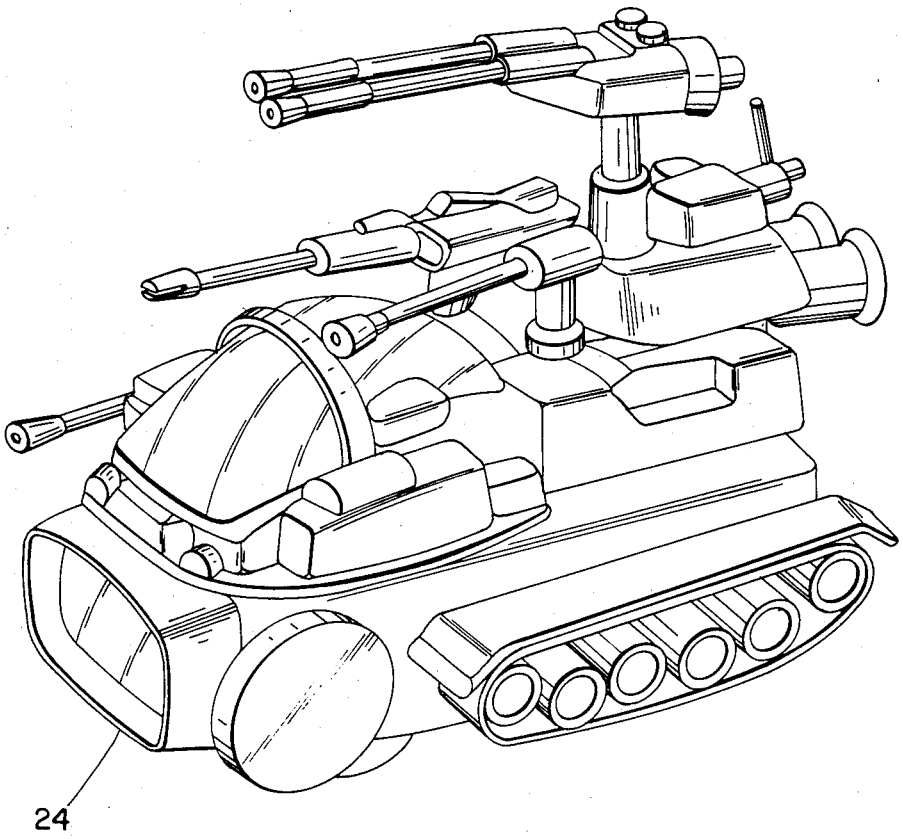
FIG. 7 is a perspective of the toy vehicle of the present invention with the snap-on parts assembled on the body to create the appearance of a space-type vehicle.

The wheeled body 2 may be used by itself as a toy vehicle, flashlight or both. In addition, the wheeled body 2 may be used as the base component or module for snap-on pieces to create a plurality of differently appearing vehicles. As best shown in FIG. 6, the body 2 may be provided with spaced apertures 66 on its top and side walls. These apertures 66 cooperatively receive the snap fitting projections 67 respectively mounted on a plurality of add on parts. These add on parts may take any form or apparent function, although snap-on "space vehicle" parts are shown as 68A through 68I in FIG. 6. The parts themselves may also have apertures 66 therein removably to mount other parts thereon as illustrated for example by apertures 66 on part 68E.

The user of the toy is thus free to assemble the various parts in any preferred arrangement to give the desired look to the assembled vehicle. An exemplary space vehicle is shown, for example, in FIG. 7 which was created by adding the snap-on parts of FIG. 6 to the base module 2. Various snap-on parts can be used having different configurations and functions to provide vehicles of different looks and apparent functions.

It will be apparent from the foregoing that changes may be made in the details of construction and configuration without departing from the spirit of the invention as defined in the following claims.

I claim:

1. A toy vehicle comprising a body having at least one idler wheel mounted thereon, electric battery removably mounted in the body, an electric circuit conductively coupled to the batteries and including contact means, a power pack including an electric motor rotatably received in the body and having a conductive strip means thereon engaged by the contact means electrically to drive the motor, and at least one driven wheel mounted on and rotatable with the power pack and driven by the motor, the at least one driven wheel extending through the body to drive the toy in any direction depending upon the relative angular orientation of the at least one driven wheel relative to the body.

2. The toy vehicle set forth in claim 1 further comprising a flashlight assembly mounted in the body and conductively connected to the electric circuit.

3. The toy vehicle set forth in claim 2 wherein the flashlight assembly is mounted in a compartment of the body, the batteries are removably received in a compartment of the body and the power pack is rotatably mounted in a compartment of the body.

4. The toy vehicle set forth in claim 3 wherein two idler wheels are mounted adjacent the front of the body and one driven wheel is mounted adjacent the rear of the body generally centrally thereof.

5. The toy vehicle set forth in claim 3 wherein the flashlight assembly includes a lamp, a lens holder and a lens, the lens entirely forming a front wall of the body.

6. The toy vehicle set forth in claim 1 or claim 4 wherein the power pack includes a thumb wheel extending radially outwardly therefrom and partially extending through the body, the thumb wheel selectively being turned to rotate the power pack relative to the body to change the angular position of the driven wheel relative to the body.

7. The toy vehicle set forth in claim 6 wherein the power pack has a bushing plate on its lower end to form a shoulder, with the bushing plate extending through a hole in a bottom wall of the body and the shoulder being positioned above the bottom wall, the contact means, thumb wheel, bushing plate and shoulder cooperating to provide a rotatable mount for the power pack in the body.

8. The toy vehicle set forth in claim 1 wherein the contact means constitute two diametrically opposed but vertically staggered brushes respectively resiliently engaging two vertically spaced annular conductive strips jointly forming the contact strip means on the power pack.

9. The toy vehicle set forth in claim 1 further comprising connection means on the body adapted removably to receive additional pieces to change the appearance of the body.

* * * * *